US006347992B1

(12) United States Patent
Durbin et al.

(10) Patent No.: US 6,347,992 B1
(45) Date of Patent: Feb. 19, 2002

(54) DUCTWORK AIR FRESHENER APPARATUS

(76) Inventors: Michael J. Durbin; Jeffrey S. Durbin, both of 640 Avondale Dr., St. Peters, MO (US) 63376

( * ) Notice: Subject to any disclaimer, the term of this patent is extended or adjusted under 35 U.S.C. 154(b) by 0 days.

(21) Appl. No.: 09/780,151

(22) Filed: Feb. 9, 2001

(51) Int. Cl.[7] ..... F24F 7/00

(52) U.S. Cl. ..... 454/337; 454/306; 422/123; 422/124; 422/306

(58) Field of Search ..... 454/337, 157, 454/306, 110, 223, 291, 328; 422/123, 124, 306

(56) References Cited

U.S. PATENT DOCUMENTS

| | | | | | |
|---|---|---|---|---|---|
| 3,499,579 | A | * | 3/1970 | Garratt | 454/337 |
| 3,627,176 | A | | 12/1971 | Sailors | |
| 3,974,941 | A | | 8/1976 | Mettler | |
| D284,788 | S | | 7/1986 | Cahuzak | |
| 4,840,773 | A | | 6/1989 | Wade | |
| 4,903,583 | A | | 2/1990 | Frazier | |
| 5,186,869 | A | * | 2/1993 | Stumpf et al. | 442/124 |
| 5,622,162 | A | | 4/1997 | Johansson et al. | |

* cited by examiner

*Primary Examiner*—Jiping Lu

(57) ABSTRACT

A ductwork air freshener apparatus for distributing fresh air evenly throughout the building using the existing air ducts of the environmental control system. The ductwork air freshener apparatus includes a housing assembly designed for mounting to the ductwork of the house. A pressurized air freshener container is removably inserted into the housing assembly. The pressurized air freshener container has a fragrance under pressure within the pressurized air freshener container. An actuation assembly is for actuating the pressurized air freshener container whereby the deodorizing fragrance is designed for introduction into the ductwork of the house. The actuation assembly is coupled to the housing assembly. A control assembly is coupled to the housing. The control assembly is operationally coupled to the actuation assembly whereby the control assembly actuates the actuation assembly upon the control assembly satisfying a predetermined condition. The control assembly has a sensor switch for detecting the predetermined condition. The sensor switch is operationally coupled to the actuation assembly whereby the sensor switch actuates the actuation assembly when the sensor switch detects the predetermined condition.

13 Claims, 6 Drawing Sheets

DUCTWORK AIR FRESHENER APPARATUS

BACKGROUND OF THE INVENTION

1. Field of the Invention

The present invention relates to air freshener apparatuses and more particularly pertains to a new ductwork air freshener apparatus to distribute fresh air evenly throughout the building using the existing air ducts of the environmental control system.

2. Description of the Prior Art

The use of air freshener apparatuses is known in the prior art. More specifically, air freshener apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,974,941; U.S. Pat. No. 3,627,176; U.S. Pat. No. 4,903,583; U.S. Pat. No. 5,622,162; U.S. Pat. No. 4,840,773; and U.S. Pat. No. Des. 284,788.

While these devices fulfill their respective, particular objectives and requirements, the aforementioned patents do not disclose a new ductwork air freshener apparatus. The inventive device includes a housing assembly designed for mounting to the ductwork of the house. A pressurized air freshener container is removably inserted into the housing assembly. The pressurized air freshener container has a fragrance under pressure within the pressurized air freshener container. An actuation assembly is for actuating the pressurized air freshener container whereby the deodorizing fragrance is designed for introduction into the ductwork of the house. The actuation assembly is coupled to the housing assembly. A control assembly is coupled to the housing. The control assembly is operationally coupled to the actuation assembly whereby the control assembly actuates the actuation assembly upon the control assembly satisfying a predetermined condition. The control assembly has a sensor switch for detecting the predetermined condition. The sensor switch is operationally coupled to the actuation assembly whereby the sensor switch actuates the actuation assembly when the sensor switch detects the predetermined condition.

In these respects, the ductwork air freshener apparatus according to the present invention substantially departs from the conventional concepts and designs of the prior art, and in so doing provides an apparatus primarily developed for the purpose of distributing fresh air evenly throughout the building using the existing air ducts of the environmental control system.

SUMMARY OF THE INVENTION

In view of the foregoing disadvantages inherent in the known types of air freshener apparatuses now present in the prior art, the present invention provides a new ductwork air freshener apparatus construction wherein the same can be utilized for distributing fresh air evenly throughout the building using the existing air ducts of the environmental control system.

The general purpose of the present invention, which will be described subsequently in greater detail, is to provide a new ductwork air freshener apparatus apparatus and method which has many of the advantages of the air freshener apparatuses mentioned heretofore and many novel features that result in a new ductwork air freshener apparatus which is not anticipated, rendered obvious, suggested, or even implied by any of the prior art air freshener apparatuses, either alone or in any combination thereof.

To attain this, the present invention generally comprises a housing assembly designed for mounting to the ductwork of the house. A pressurized air freshener container is removably inserted into the housing assembly. The pressurized air freshener container has a fragrance under pressure within the pressurized air freshener container. An actuation assembly is for actuating the pressurized air freshener container whereby the deodorizing fragrance is designed for introduction into the ductwork of the house. The actuation assembly is coupled to the housing assembly. A control assembly is coupled to the housing. The control assembly is operationally coupled to the actuation assembly whereby the control assembly actuates the actuation assembly upon the control assembly satisfying a predetermined condition. The control assembly has a sensor switch for detecting the predetermined condition. The sensor switch is operationally coupled to the actuation assembly whereby the sensor switch actuates the actuation assembly when the sensor switch detects the predetermined condition.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ductwork air freshener apparatus apparatus and method which has many of the advantages of the air freshener apparatuses mentioned heretofore and many novel features that result in a new ductwork air freshener apparatus which is not anticipated, rendered obvious, suggested, or even implied by any of the prior art air freshener apparatuses, either alone or in any combination thereof.

It is another object of the present invention to provide a new ductwork air freshener apparatus which may be easily and efficiently manufactured and marketed.

It is a further object of the present invention to provide a new ductwork air freshener apparatus which is of a durable and reliable construction.

An even further object of the present invention is to provide a new ductwork air freshener apparatus which is susceptible of a low cost of manufacture with regard to both materials and labor, and which accordingly is then susceptible of low prices of sale to the consuming public, thereby making such ductwork air freshener apparatus economically available to the buying public.

Still yet another object of the present invention is to provide a new ductwork air freshener apparatus which provides in the apparatuses and methods of the prior art some of the advantages thereof, while simultaneously overcoming some of the disadvantages normally associated therewith.

Still another object of the present invention is to provide a new ductwork air freshener apparatus for distributing fresh air evenly throughout the building using the existing air ducts of the environmental control system.

Yet another object of the present invention is to provide a new ductwork air freshener apparatus which includes a housing assembly designed for mounting to the ductwork of the house. A pressurized air freshener container is removably inserted into the housing assembly. The pressurized air freshener container has a fragrance under pressure within the pressurized air freshener container. An actuation assembly is for actuating the pressurized air freshener container whereby the deodorizing fragrance is designed for introduction into the ductwork of the house. The actuation assembly is coupled to the housing assembly. A control assembly is coupled to the housing. The control assembly is operationally coupled to the actuation assembly whereby the control assembly actuates the actuation assembly upon the control assembly satisfying a predetermined condition. The control assembly has a sensor switch for detecting the predetermined condition. The sensor switch is operationally coupled to the actuation assembly whereby the sensor switch actuates the actuation assembly when the sensor switch detects the predetermined condition.

Still yet another object of the present invention is to provide a new ductwork air freshener apparatus that allows a user to have just one air freshener that will automatically freshen every room in the house.

Even still another object of the present invention is to provide a new ductwork air freshener apparatus that allows a user to adjust the level of freshness desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
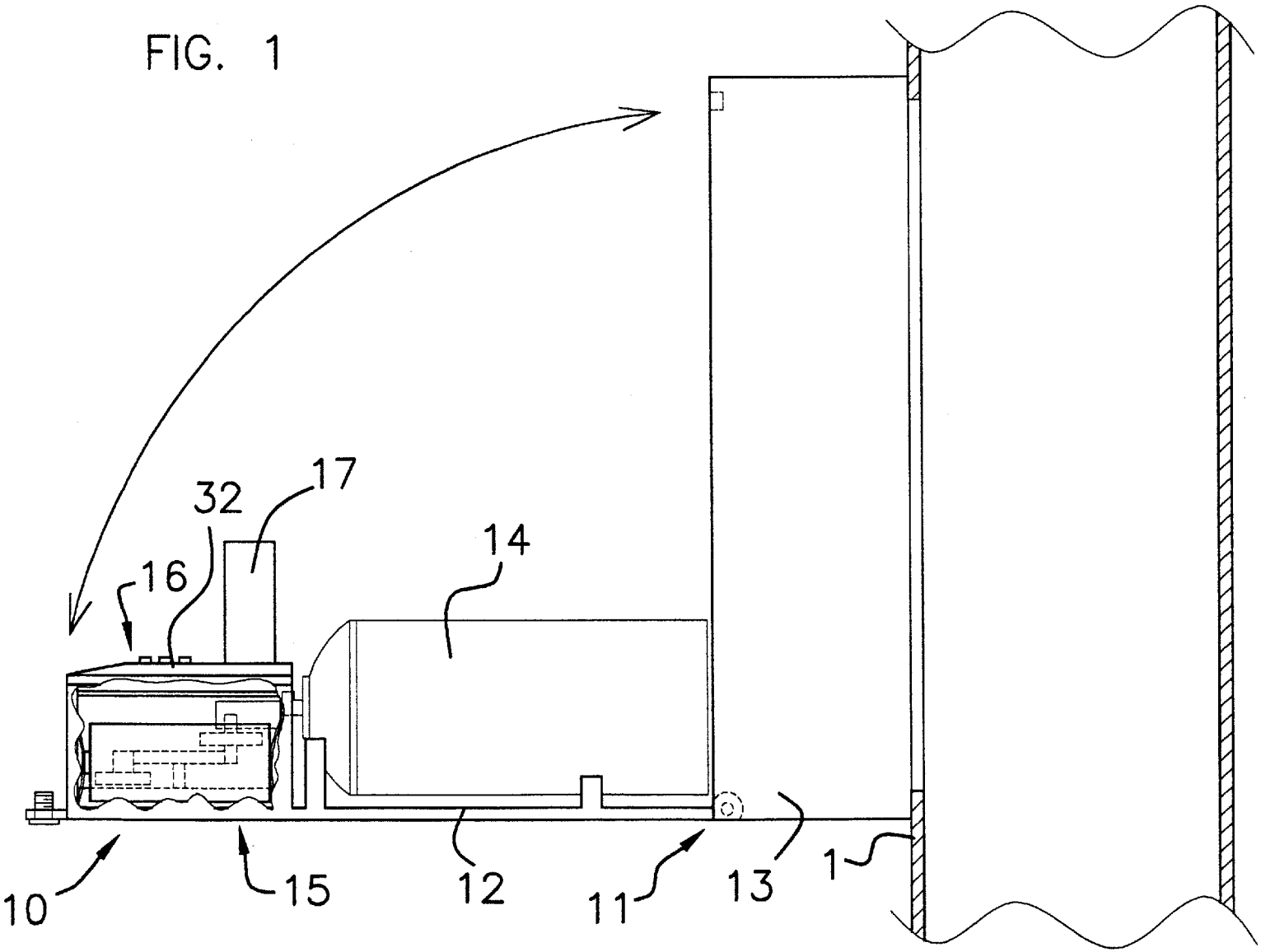
FIG. 1 is a side view of a new ductwork air freshener apparatus according to the present invention.
Figure 2:
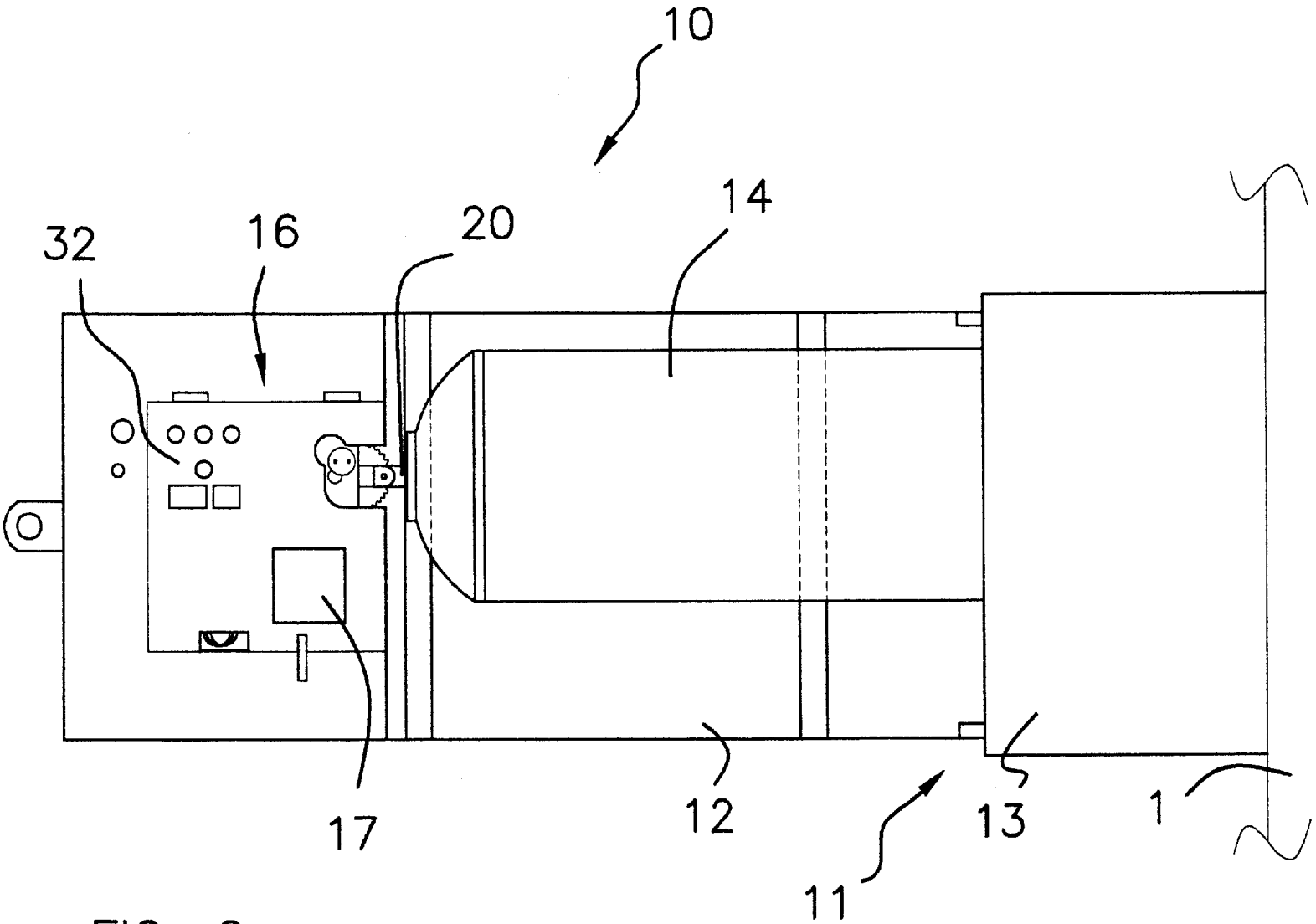
FIG. 2 is a top view of the present invention.
Figure 3:
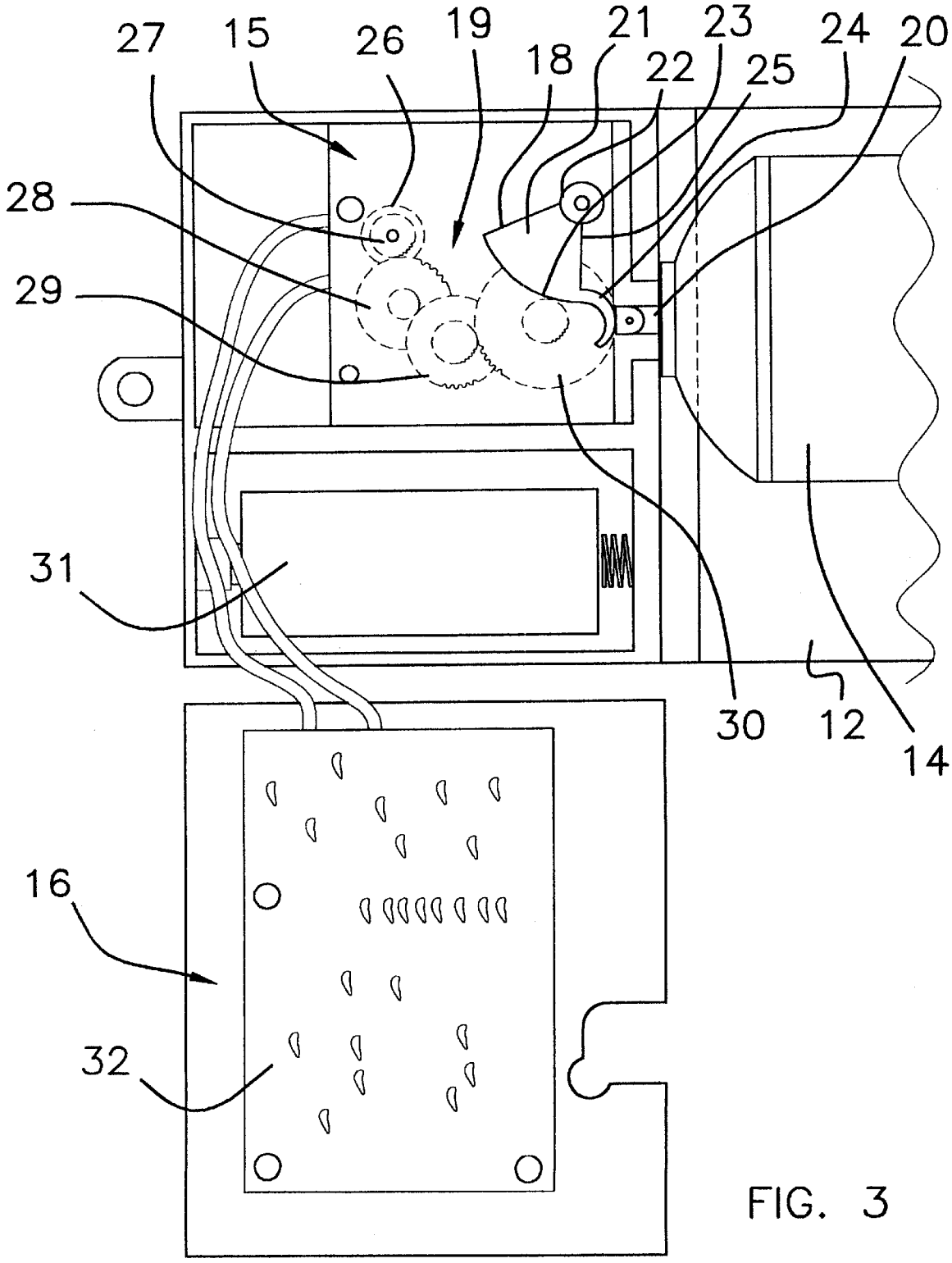
FIG. 3 is an enlarged top view of the present invention.
Figure 4:
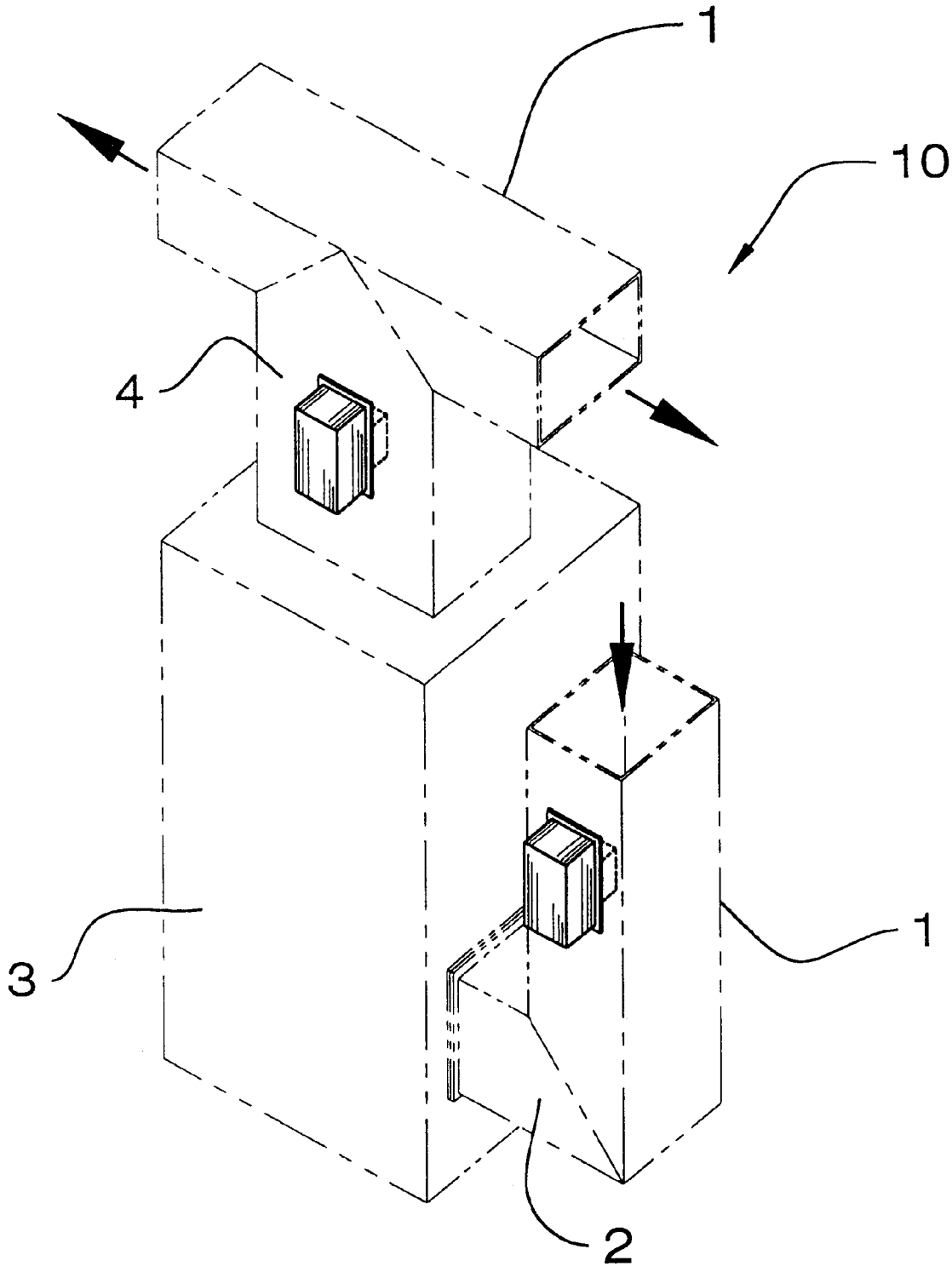
FIG. 4 is a perspective view showing alternate locations of the present invention.
Figure 5:
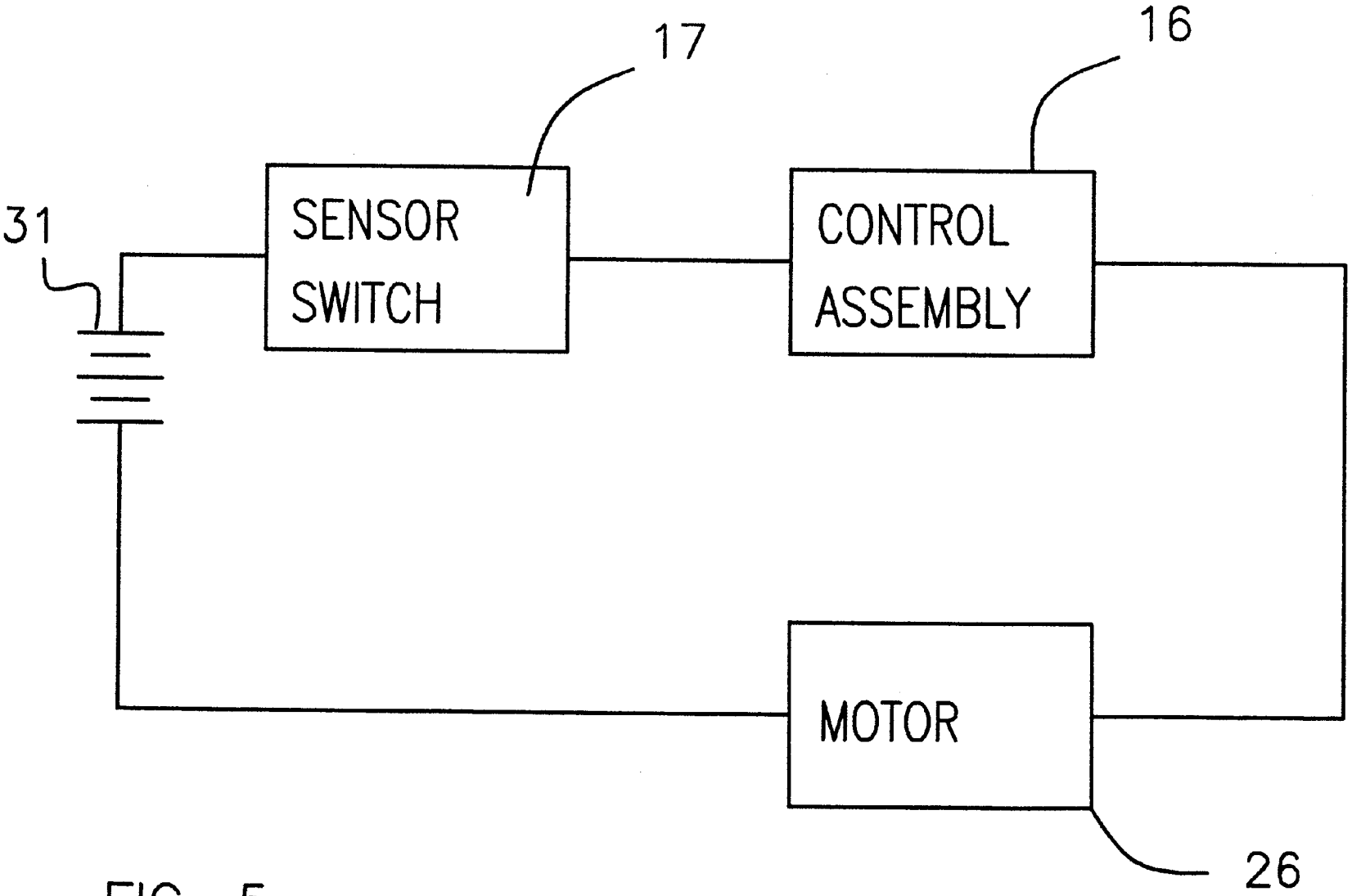
FIG. 5 is a schematic view of the present invention.
Figure 6:
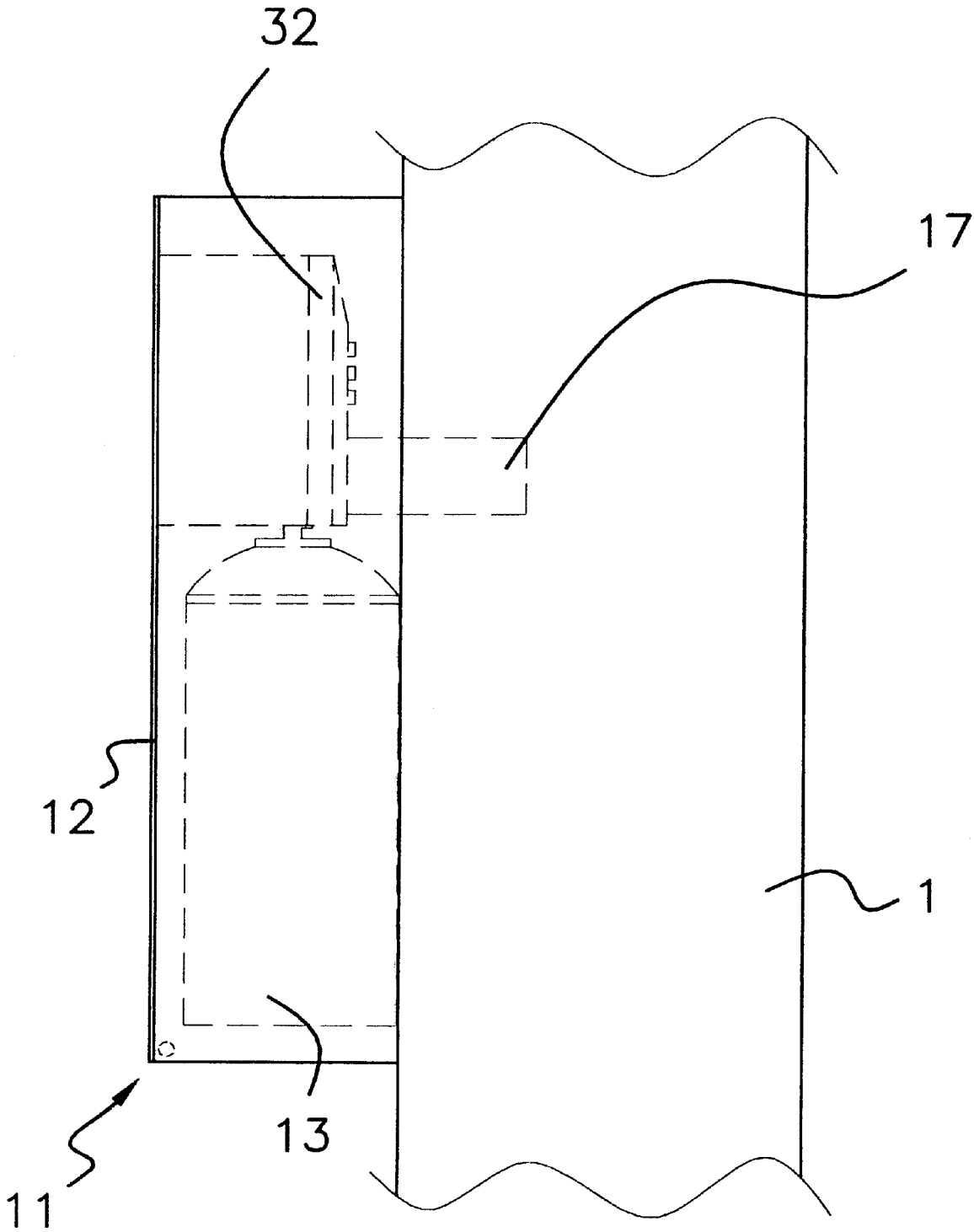
FIG. 6 is a side view of the present invention with the housing assembly closed.

With reference now to the drawings, and in particular to FIGS. 1 through 4 thereof, a new ductwork air freshener apparatus embodying the principles and concepts of the present invention and generally designated by the reference numeral 10 will be described.

As best illustrated in FIGS. 1 through 4, the ductwork 1 air freshener apparatus 10 generally comprises a housing assembly 11 is designed for mounting to the ductwork 1 of the house. The housing assembly 11 has a mounting plate 12 hingably coupled to a cover portion 13. The mounting plate 12 is rotatable downwards whereby a pressurized air freshener container 14 is removably inserted into the housing assembly 11. The cover portion 13 of said housing assembly 11 is designed for coupling to the ductwork 1 on an air intake side 2 of an air handling unit 3. In an alternate embodiment the housing assembly 11 is designed for coupling to the ductwork 1 on an air outlet side 4 of an air handling unit 3.

The pressurized air freshener container 14 is removably inserted into the housing assembly 11. The pressurized air freshener container 14 has a fragrance under pressure within the pressurized air freshener container 14.

An actuation assembly 15 is for actuating the pressurized air freshener container 14 whereby the deodorizing fragrance is designed for introduction into the ductwork 1 of the house. The actuation assembly 15 is coupled to the mounting plate 12 of the housing assembly 11.

A control assembly 16 is coupled to the mounting plate 12 of the housing assembly 11. The control assembly 16 is operationally coupled to the actuation assembly 15 whereby the control assembly 16 actuates the actuation assembly 15 upon the control assembly 16 satisfying a predetermined condition. The control assembly 16 has a sensor switch 17 for detecting the predetermined condition. The sensor switch 17 is operationally coupled to the actuation assembly 15 whereby the sensor switch 17 actuates the actuation assembly 15 when the sensor switch 17 detects the predetermined condition.

The actuation assembly 15 has a depression member 18 and a gear assembly 19. The gear assembly 19 is for actuating the depression member 18. The depression member 18 is for actuating a nozzle 20 of the pressurized air freshener container 14 whereby the fragrance from the pressurized air freshener container 14 is released into the duct work.

The depression member 1 8 has a base portion 21 rotatably coupled to the housing assembly I1. The base portion 21 is substantially triangular shaped such that an apex 22 is rotatably coupled to the housing assembly 11. An engaging edge 23 of the base member is positioned opposite the apex 22. The engaging edge 23 is arcuate whereby the engaging edge 23 is for engaging the gear assembly 19. The depression member 18 has an actuating arm 24 arcuatly extending from a bottom edge 25 of the base portion 21 adjacent the engaging edge 23 of the base portion 21. The actuating arm 24 is for engaging the nozzle 20 of the pressurized air freshener container 14 whereby the actuating arm 24 depresses the nozzle 20 when the depression member 18 is rotated downwards by the gear assembly 19.

The gear assembly 19 comprises a motor 26 coupled to a drive gear 27 whereby the motor 26 is for rotating the drive gear 27. The motor 26 is operationally coupled to the control assembly 16. The drive gear 27 is operationally coupled to a first gear 28 whereby the drive gear 27 is for rotating the first gear 28 when the drive gear 27 is rotated by the motor 26. The first gear 28 is operationally coupled to a second gear 29 whereby the first gear 28 is for rotating the second gear 29 when the first gear 28 is rotated by the drive gear 27. The second gear 29 is operationally coupled to a third gear 30 whereby the second gear 29 is for rotating the third gear 30 when the second gear 29 is rotated by the first gear 28. The third gear 30 is operationally coupled to the engaging edge 23 of the depression member 18 whereby the third gear 30 is for rotating the depression member 18.

The control assembly 16 has a power supply 31 operationally coupled to the sensor switch 17. The control assembly 16 has a controller 32 operationally coupled between the sensor switch 17 and the actuation assembly 15. The controller 32 is for controlling power to the actuation assembly 15 whereby the controller 32 provides power to the actuation assembly 15 upon a predetermined time span of the controller 32 elapsing. The predetermined time span is initiated when the sensor switch 17 detects the predetermined condition. The predetermined time span is reinitiated upon elapsing of the predetermined time span when the sensor switch detects the predetermined condition.

The sensor switch 17 is designed for being positioned within the airflow of the ductwork 1. The sensor switch 17 is for detecting changes in pressure. The predetermined condition is a drop in pressure around the sensor switch 17 when the air flow in the ductwork 1 is moving past the sensor switch 17. In an alternate the sensor switch 17 can comprise a photo electric cell, a motion detector or a sail switch for detecting movement of the air in the ductwork 1 of the house.

In use, a user would have the present invention installed in the ductwork of an existing environmental control system. The present invention would mist a scent into the air at user selected intervals when the environmental control systems fan is on. This would provide fresh air to the entire building.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A ductwork air freshener apparatus for introducing a scented fragrance into a ductwork of a forced air system, said ductwork air freshener apparatus comprising:

a housing assembly being adapted for mounting to the ductwork of the house;

a pressurized air freshener container being removably inserted into said housing assembly, said pressurized air freshener container having a fragrance under pressure within said pressurized air freshener container;

an actuation assembly being for actuating said pressurized air freshener container such that said deodorizing fragrance is adapted for introduction into the ductwork of the house, said actuation assembly being coupled to said housing assembly;

a control assembly being coupled to said housing assembly, said control assembly being operationally coupled to said actuation assembly such that said control assembly actuates said actuation assembly upon said control assembly satisfying a predetermined condition; and said control assembly having a sensor switch being for detecting said predetermined condition, said sensor switch being operationally coupled to said actuation assembly such that said sensor switch actuates said actuation assembly when said sensor switch detects said predetermined condition.

2. The ductwork air freshener apparatus as set forth in claim 1, wherein said housing assembly has a mounting plate hingably coupled to a cover portion, said mounting plate being rotatable downwards such that said pressurized air freshener container is removably inserted into said housing assembly; and said cover portion of said housing assembly being adapted for coupling to the ductwork on an air intake side of an air handling unit.

3. The ductwork air freshener apparatus as set forth in claim 1, wherein said actuation assembly has a depression member and a gear assembly, said gear assembly being for actuating said depression member such that said depression member is for actuating a nozzle of said pressurized air freshener container such that said fragrance from said pressurized air freshener container is released into the duct work.

4. The ductwork air freshener apparatus as set forth in claim 3, wherein said depression member has a base portion rotatably coupled to said housing assembly, said base portion being substantially triangular shaped such that an apex is rotatably coupled to said housing assembly, an engaging edge of said base member being positioned opposite said apex, said engaging edge being arcuate such that said engaging edge is for engaging said gear assembly, said depression member having an actuating arm arcuatly extending from a bottom edge of said base portion adjacent said engaging edge of said base portion, said actuating arm being for engaging said nozzle of said pressurized air freshener container such that said actuating arm depresses said nozzle when said depression member is rotated downwards by said gear assembly.

5. The ductwork air freshener apparatus as set forth in claim 4, wherein said gear assembly comprises a motor coupled to a drive gear such that said motor is for rotating said drive gear, said motor being operationally coupled to said control assembly, said drive gear being operationally coupled to a first gear such that said drive gear is for rotating said first gear when said drive gear is rotated by said motor, said first gear being operationally coupled to a second gear such that said first gear is for rotating said second gear when said first gear is rotated by said drive gear, said second gear being operationally coupled to a third gear such that said second gear is for rotating said third gear when said second gear is rotated by said first gear, said third gear being operationally coupled to said engaging edge of said depression member such that said third gear is for rotating said depression member.

6. The ductwork air freshener apparatus as set forth in claim 1, wherein said control assembly has a power supply operationally coupled to said sensor switch.

7. The ductwork air freshener apparatus as set forth in claim 6, wherein said control assembly has a controller operationally coupled between said sensor switch and said actuation assembly, said controller being for controlling power to said actuation assembly such that said controller provides power to said actuation assembly upon a predetermined time span of said controller elapsing, said predetermined time span being initiated when said sensor switch detects said predetermined condition.

8. The ductwork air freshener apparatus as set forth in claim 7, wherein said predetermined time span is reinitiated upon elapsing of said predetermined time span when said sensor switch detects said predetermined condition.

9. The ductwork air freshener apparatus as set forth in claim 1, wherein said sensor switch is adapted for being positioned within the airflow of the ductwork, said sensor switch being for detecting changes in pressure; and said predetermined condition being a drop in pressure around said sensor switch when the air flow in the ductwork is moving past said sensor switch.

10. The ductwork air freshener apparatus as set forth in claim 1, wherein said housing assembly has a mounting plate hingably coupled to a cover portion, said mounting plate being rotatable downwards such that said pressurized air freshener container is removably inserted into said housing assembly.; and said housing assembly being adapted for coupling to the ductwork on an air outlet side of an air handling unit.

11. A ductwork air freshener apparatus for introducing a scented fragrance into a ductwork of a forced air system, said ductwork air freshener apparatus comprising:

a housing assembly being adapted for mounting to the ductwork of the house;

a pressurized air freshener container being removably inserted into said housing assembly, said pressurized air freshener container having a fragrance under pressure within said pressurized air freshener container;

an actuation assembly being for actuating said pressurized air freshener container such that said deodorizing fragrance is adapted for introduction into the ductwork of the house, said actuation assembly being coupled to said housing assembly;

a control assembly being coupled to said housing assembly, said control assembly being operationally coupled to said actuation assembly such that said control assembly actuates said actuation assembly upon said control assembly satisfying a predetermined condition;

said control assembly having a sensor switch being for detecting said predetermined condition, said sensor switch being operationally coupled to said actuation assembly such that said sensor switch actuates said actuation assembly when said sensor switch detects said predetermined condition;

said actuation assembly having a depression member and a gear assembly, said gear assembly being for actuating said depression member such that said depression member is for actuating a nozzle of said pressurized air freshener container such that said fragrance from said pressurized air freshener container is released into the duct work;

said depression member having a base portion rotatably coupled to said housing assembly, said base portion being substantially triangular shaped such that an apex is rotatably coupled to said housing assembly, an engaging edge of said base member being positioned opposite said apex, said engaging edge being arcuate such that said engaging edge is for engaging said gear assembly, said depression member having an actuating arm arcuatly extending from a bottom edge of said base portion adjacent said engaging edge of said base portion, said actuating arm being for engaging said nozzle of said pressurized air freshener container such that said actuating arm depresses said nozzle when said depression member is rotated downwards by said gear assembly;

said gear assembly comprising a motor coupled to a drive gear such that said motor is for rotating said drive gear, said motor being operationally coupled to said control assembly, said drive gear being operationally coupled to a first gear such that said drive gear is for rotating said first gear when said drive gear is rotated by said motor, said first gear being operationally coupled to a second gear such that said first gear is for rotating said second gear when said first gear is rotated by said drive gear, said second gear being operationally coupled to a third gear such that said second gear is for rotating said third gear when said second gear is rotated by said first gear, said third gear being operationally coupled to said engaging edge of said depression member such that said third gear is for rotating said depression member;

said control assembly having a power supply operationally coupled to said sensor switch;

said control assembly having a controller operationally coupled between said sensor switch and said actuation assembly, said controller being for controlling power to said actuation assembly such that said controller provides power to said actuation assembly upon a predetermined time span of said controller elapsing, said predetermined time span being initiated when said sensor switch detects said predetermined condition;

said predetermined time span being reinitiated upon elapsing of said predetermined time span when said sensor switch detects said predetermined condition;

said sensor switch being adapted for being positioned within the airflow of the ductwork, said sensor switch being for detecting changes in pressure; and said predetermined condition being a drop in pressure around said sensor switch when the air flow in the ductwork is moving past said sensor switch.

12. The ductwork air freshener apparatus as set forth in claim 11, wherein said housing assembly has a mounting plate hingably coupled to a cover portion, said mounting plate being rotatable downwards such that said pressurized air freshener container is removably inserted into said housing assembly; and said cover portion of said housing assembly being adapted for coupling to the ductwork on an air intake side of an air handling unit.

13. The ductwork air freshener apparatus as set forth in claim 11, wherein said housing assembly has a mounting plate hingably coupled to a cover portion, said mounting plate being rotatable downwards such that said pressurized air freshener container is removably inserted into said housing assembly.; and said housing assembly being adapted for coupling to the ductwork on an air outlet side of an air handling unit.

* * * * *